US008869875B2

(12) United States Patent
Kernig et al.

(10) Patent No.: US 8,869,875 B2
(45) Date of Patent: Oct. 28, 2014

(54) ALUMINUM ALLOY FREE FROM ALUMINUM CARBIDE

(75) Inventors: Bernhard Kernig, Cologne (DE); Werner Droste, Bonn (DE); Henk-Jan Brinkman, Bonn (DE)

(73) Assignee: Hydro Aluminium Deutschland GmbH, Köln (DE)

( * ) Notice: Subject to any disclaimer, the term of this patent is extended or adjusted under 35 U.S.C. 154(b) by 0 days.

(21) Appl. No.: 13/423,602

(22) Filed: Mar. 19, 2012

(65) Prior Publication Data

US 2012/0195788 A1 Aug. 2, 2012

Related U.S. Application Data

(62) Division of application No. 12/279,107, filed on Feb. 13, 2009, now abandoned.

(30) Foreign Application Priority Data

Feb. 13, 2006 (EP) ..... 06 002 809
Feb. 13, 2007 (WO) ..... PCT/EP2007/051404

(51) Int. Cl.

| | |
|---|---|
| ***B22D 11/11*** | (2006.01) |
| ***B22D 11/119*** | (2006.01) |
| ***C22C 21/00*** | (2006.01) |
| ***C22B 21/06*** | (2006.01) |

(52) U.S. Cl.

CPC ..... *C22B 21/06* (2013.01); *C22C 21/00* (2013.01)
USPC ..... 164/462; 164/475; 148/551; 75/680

(58) Field of Classification Search

USPC ..... 164/462, 475; 75/680; 148/551
See application file for complete search history.

(56) References Cited

U.S. PATENT DOCUMENTS

| | | | | |
|---|---|---|---|---|
| 1,743,515 | A | 1/1930 | Anderson | |
| 3,721,546 | A * | 3/1973 | Shiba et al. | 75/10.27 |
| 4,003,738 | A * | 1/1977 | Valdo | 75/675 |
| 5,104,743 | A | 4/1992 | Nishikawa et al. | |
| 6,447,982 | B1 | 9/2002 | von Asten et al. | |
| 7,118,848 | B2 * | 10/2006 | Hotta et al. | 430/302 |
| 2004/0047759 | A1 | 3/2004 | Rottwinkel et al. | |
| 2004/0173053 | A1 * | 9/2004 | Aune et al. | 75/10.27 |
| 2005/0013724 | A1 | 1/2005 | Ougi et al. | |

FOREIGN PATENT DOCUMENTS

| | | |
|---|---|---|
| EP | 0164856 | 12/1985 |
| EP | 1065071 | 1/2001 |
| JP | 01247547 | 10/1989 |
| JP | 11061364 | 3/1999 |
| JP | 2000309829 | 11/2000 |
| JP | 2004292862 | 10/2004 |
| WO | 2007/045676 | 4/2007 |

OTHER PUBLICATIONS

International Search Report for PCT/EP2007/051404, Feb. 5, 2007.
Aluminum and Aluminum Alloys, ASM International, 1993, p. 41, 639.
Christian J. Simensen, Gas-Chromatographic Analysis of Carbides in Aluminium and Magnesium, Fresenius Z. Anal. Chem, (1978), 292, 207-212.

* cited by examiner

*Primary Examiner* — Kevin P Kerns
(74) *Attorney, Agent, or Firm* — Proskauer Rose LLP

(57) ABSTRACT

An aluminum alloy for producing an aluminum strip for lithographic print plate carriers, a method for producing an aluminum alloy for lithographic print plate carriers, in which, during the production of the aluminum alloy, after the electrolysis of the aluminum oxide, the liquid aluminum, up to the casting of the aluminum alloy, is supplied to a plurality of purification steps, as well as an aluminum strip for lithographic print plate carriers and a corresponding use of the aluminum strip for lithographic print plate carriers include a carbide content of less than 10 ppm, and preferably less than 1 ppm. As a result, the aluminum alloy, the method for producing the aluminum alloy, the aluminum strip, and corresponding use of the aluminum strip for lithographic print plate carriers described herein allow for the use of virtually gas-tight coatings.

18 Claims, 1 Drawing Sheet

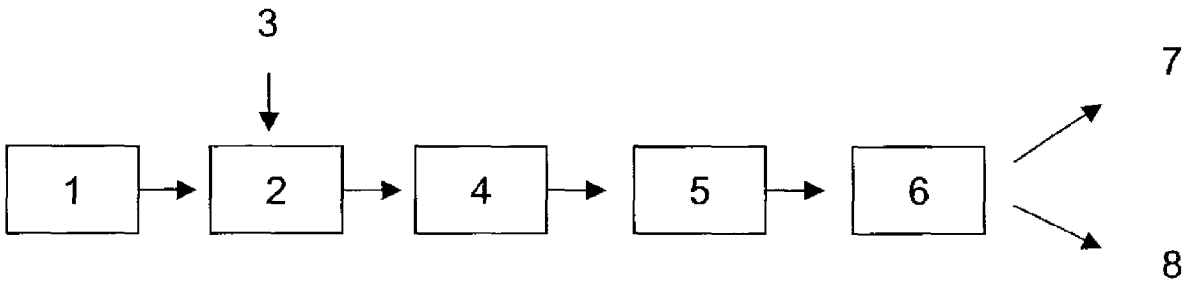
1
2
3
4
5
6
7
8

ALUMINUM ALLOY FREE FROM ALUMINUM CARBIDE

CROSS-REFERENCE TO RELATED APPLICATIONS

This application is a divisional of U.S. patent application Ser. No. 12/279,107, filed on Feb. 13, 2009, now abandoned, which is a National Phase Application of International Application No. PCT/EP2007/051404, filed on Feb. 13, 2007, which claims the benefit of and priority to European Patent Application No. EP 06 002 809.9, filed on Feb. 13, 2006. The disclosure of the above applications are incorporated herein by reference in their entirety.

FIELD OF THE INVENTION

The invention relates to an aluminum alloy for producing an aluminum strip for lithographic print plate carriers a method for producing an aluminum alloy for lithographic print plate carriers, in which, during the production of the aluminum alloy, after the electrolysis of the aluminum oxide, the liquid aluminum is supplied to a plurality of purification steps, as well as an aluminum strip for lithographic print plate carriers and a corresponding use of the aluminum strip for lithographic print plate carriers.

BACKGROUND OF THE INVENTION

Print plate carriers for the lithographic print made of an aluminum alloy have to satisfy very high requirements to be suitable for current printing technology. On the one hand, the print plate carrier produced from an aluminum strip has to be able to be roughened homogeneously, with mechanical, chemical and electrochemical roughening methods and a combination thereof being used. On the other hand, the print plates are frequently subjected after exposure and development to a burning-in process at between 220 and 300° C. with an annealing time of 3 to 10 min., in order to harden the photolayer applied. On the one hand, to satisfy the requirement profile, various aluminum alloys have been developed. On the other hand, further developments in the area of coatings of the print plate carriers were carried out, which were to further improve the stability of the print plate carriers during printing and therefore their service life. Novel coatings which are virtually gas-tight have achieved good results. However, the print plate carriers, produced from the aluminum alloys available until now, tend to bubble formation between the print plate carrier and the coating. This bubble formation then ultimately leads to tearing of the coating and therefore to the failure of the print plate.

SUMMARY OF THE INVENTION

In general, in one aspect, embodiments of the present invention provide an aluminum alloy for producing an aluminum strip for lithographic print plate carriers and a corresponding aluminum strip for lithographic print plate carriers, from which or with which lithographic print plate carriers can be produced which allow the use of virtually gas-tight coatings. In addition, embodiments of the invention provide a method for producing a corresponding aluminum alloy and an advantageous use of the aluminum strip for lithographic print plate carriers.

According to a first embodiment of the present invention, an aluminum alloy has an aluminum carbide content of less than 10 ppm, preferably less than 1 ppm. It has surprisingly been found that print plate carriers, which have been produced from an aluminum alloy with correspondingly low aluminum carbide contents, allow the use of gas-tight coatings as bubble formation is extremely low. It is assumed that the slightest traces of aluminum carbide ($Al_4C_3$) and the reaction thereof with moisture with the formation of methane gas leads to bubble formation under the gas-tight coatings. It was surprisingly found that in particular the composition of the aluminum alloy of the print plate carrier plays an important role in bubble formation although it had previously been assumed that this was substantially a phenomenon caused by the surface of the print plate carriers. Previous aluminum alloys were therefore not optimized to an aluminum carbide content which was as low as possible. However, it has been shown that even at an aluminum carbide content of less than 10 ppm, bubble formation is considerably reduced and corresponding aluminum alloys can be used to produce suitable print plate carriers. The aluminum carbide content of the aluminum alloy according to an embodiments of the invention is preferably adjusted to less than 1 ppm, so bubble formation is prevented with a gas-tight coating of the print plate carrier.

In some embodiments of the present invention, in order to provide further mechanical, chemical or electrochemical requirements of a lithographic print plate carrier, the further composition of the aluminum alloy preferably corresponds to an aluminum alloy of the type AA1xxx, AA3xxx, AA8xxx, preferably AA1050 or AA3103. It is known of said aluminum alloys that they at least partially satisfy the requirements made for lithographic print plate carriers and were previously used to produce them. Owing to the reduction according to the invention of the aluminum carbide content to less than 10 ppm or 1 ppm, the good mechanical, chemical and electrochemical properties of said aluminum alloys can also be utilized in print plate carriers with a gas-tight coating.

As an alternative to the aluminum alloys disclosed above, the aluminum alloy according to the invention may have the following alloying constituents in % by weight:

$0.05\% \leq Mg \leq 0.3\%$,
$Mn \leq 0.3\%$,
$0.4\% \leq Fe \leq 1\%$,
$0.05\% \leq Si \leq 0.5\%$,
$Cu \leq 0.04\%$,
$Ti \leq 0.04\%$, unavoidable impurities individually max. 0.01%, in total max. 0.05% and remainder Al.

This aluminum alloy protected by a European patent application with the application number 05 022 772 (corresponding to international application publication number WO2007045676) from the Applicant combines good chemical and electrochemical roughening properties with improved mechanical properties, in particular after carrying out a burning-in process.

The alternative aluminum alloy, which has the following alloying constituents in % by weight:

$0.1\% \leq Mg \leq 0.3\%$,
$Mn \leq 0.05\%$,
$0.3\% \leq Fe \leq 0.4\%$,
$0.05\% \leq Si \leq 0.25\%$,
$Cu \leq 0.04\%$,
$Ti \leq 0.04\%$, unavoidable impurities individually max. 0.01%, in total max. 0.05% and remainder Al is particularly suitable, because of its balanced properties with regard to mechanical stability, chemical and electrochemical roughening ability, for producing lithographic print plate carriers. This aluminum alloy is in turn decisively improved with respect to the production of print plate carriers provided with a virtually gas-tight coating by the reduction according to the invention of the aluminum carbide content.

According to a second aspect of the present invention, a method is provided in which the proportion of aluminum carbides in the aluminum alloy is lowered by one or more purification step(s) to less than 10 ppm, preferably to less than 1 ppm. The purification steps of aluminum alloys previously aimed to reduce other impurities, such as, for example, alkaline earth metals or alkali metals, the aluminum carbides also being removed from the aluminum melt, of course. The aluminum carbide contents of the conventionally produced aluminum alloys were consequently clearly above the values according to the invention. However, it has been shown that by targeted matching of individual known purification steps to the removal of aluminum carbides, but also by means of the combination thereof with conventionally configured purification steps, very low aluminum carbide contents can be achieved in the production of the aluminum alloys directly prior to the casting of the aluminum alloy. The purification and processing steps described below of the aluminum alloy can therefore be used according to the invention both individually and also combined.

According to an embodiment of the method according to the invention, after the electrolysis of the aluminum oxide, the liquid aluminum is preferably supplied to a stirring station, in which inert gases are introduced into the liquid aluminum whilst stirring, the duration of the stirring and blowing-in of the inert gas into the aluminum melt in the stirring station being at least 10 min., preferably 15 min. It was previously known that substantially the alkali metals and alkaline earth metals are removed from the aluminum melt in the stirring station with the blowing-in of inert gases and stirring. For this purpose, stirring and gassing times of typically 6 to 8 minutes were sufficient. However, it was surprisingly shown that carbon which had arrived in the aluminum melt in particular during the electrolysis of the aluminum oxide and which substantially leads to the formation of aluminum carbide compounds in the aluminum melt can be significantly reduced by a longer period of stirring and blowing-in of inert gases. A maximum duration cannot be given for this reason. However, tests have shown that the duration of the stirring and blowing-in of the gases can be increased to about 15 to 20 min. to achieve a compromise between economy and effective removal of the aluminum carbide from the aluminum alloy.

Alternatively or accumulatively with respect to the lengthened stirring time, a reduction in the aluminum carbide content of the molten aluminum is produced in that the liquid aluminum supplied to the stirring station has been obtained at least partially from cold metal. Cold metal is aluminum which has already come from electrolysis of aluminum oxide, and which has passed through several method steps after the electrolysis, for example including a stirring station. The aluminum carbide content of the cold metal supplied is therefore typically substantially lower than that of liquid aluminum originating from the electrolysis. It is assumed that the burn-off of the graphite electrodes used in the electrolysis contributes to the aluminum carbide content of the aluminum melt produced from aluminum oxide.

The aluminum carbide content of the aluminum alloy according to the invention is additionally further reduced in that when stirring the liquid aluminum in the stirring station, aluminum fluorides are added. These remove the alkali metals sodium, calcium and lithium but also, by means of oxidation, in particular elements such as titanium and phosphorous. At the same time, however, it was possible to establish that the aluminum carbide content of the aluminum melt is also reduced.

For further reduction of the aluminum carbide content, the aluminum, according to a next developed embodiment of the method according to the invention, is supplied to a furnace to add the alloying constituents, the aluminum being left to stand in the furnace for at least more than 30 min., preferably at least more than 60 min., after which by stirring and the addition of the alloying constituents, the alloying has taken place in the furnace. It is thereby achieved that the aluminum carbide compounds generally contained in gas bubbles of the gas previously introduced into the aluminum melt can migrate together therewith to the surface of the aluminum melt and form there a part of the dross to be removed from the melt.

If a gas flushing takes place in the furnace with reactive and/or inert gases, not only can further aluminum carbide compounds be flushed out of the aluminum melt with the gas, but the added alloying constituents can, at the same time, be homogeneously distributed in the aluminum melt.

A further removal of undesired substances from the aluminum melt, in particular including aluminum carbide compounds, is achieved in that the aluminum alloy is supplied to a rotor degassing and flushed with a mixture of inert and/or reactive gases, in particular argon, nitrogen and/or chlorine. By means of this rotor degassing, the aluminum carbide compounds which have arrived in the aluminum melt during the addition of the alloying constituents, as well as other undesired compounds, can be removed from the melt of the aluminum alloy.

The aluminum alloy can be subjected to at least one segregation step, in which the aluminum alloy is heated to slightly above the solidus temperature of the aluminum alloy, so that melted, heavily contaminated phases can be pressed out of the aluminum alloy. These heavily contaminated phases of the aluminum alloy additionally contain aluminum carbide compounds, which can be removed in this manner from the aluminum melt.

Finally, embodiments of the invention can feature methods used to produce an aluminum alloy for lithographic print plate carriers and include a reduction in the aluminum carbide content in that the aluminum alloy is filtered before the continuous or strip casting, the filter having a high filter effectiveness for particles with a size of less than or equal to 5 μm. It is obvious that the filter effectiveness of these filters is also high for larger particles with a size of significantly more than 5 μm. It was established that the aluminum carbides are generally primarily present in contamination particles with a size of more than 10 μm, so by filtering the aluminum alloy, an additional reduction in the aluminum carbide content is achieved. As the filtering of the aluminum alloy takes place directly before the casting of the aluminum alloy, a high control value is attributed to this step, in particular in combination with the previously outlined measures. To ensure this filtering, two-stage filters are used, for example, which consist of a first ceramic foam filter with a downstream deep bed filter. The addition of grain refining material can preferably take place between the two filters to ensure as high an effectivity as possible of the ceramic foam filter by the building of a filter cake, and to ensure a long service life of the downstream deep bed filter.

According to another aspect of the present invention, an aluminum strip for lithographic print plate carriers is produced by continuous or discontinuous casting of an aluminum alloy according to the invention with subsequent hot and/or cold forming, the aluminum alloy according to the invention having been produced in particular using the method according to the invention. The aluminum strip according to the invention then consists of a material which is extremely low in aluminum carbide, so that it is ideally suited for producing print plate carriers with a gas-tight coating.

An aluminum strip with only a few aluminum carbide compounds on the surface thereof and in the core material can be provided in that the rolling oil residues on the aluminum strip for lithographic print plate carriers have been removed by annealing and degreasing the strip.

The aluminum strip can be subjected to a first degreasing using an acid or alkaline medium and then subjected to further purification using a pickling process, so that the removal of aluminum carbide on the surface is even more thorough. An aluminum strip can thus be provided with a further reduced quantity of aluminum carbide compounds on the surface thereof. As already described above, the aluminum alloy of the aluminum strip according to the invention itself has very low proportions of aluminum carbide compounds, so that in combination with the then virtually aluminum carbide-free surface of the aluminum strip, an aluminum strip for lithographic print plate carriers, which is ideal for coating with gas-tight coatings, is provided.

Finally, according to a fourth aspect of the present invention, the aluminum strip according to the invention is used to produce lithographic print plate carriers with a gas-tight coating.

There are now a large number of possibilities for configuring and developing the aluminum alloy according to the invention for producing an aluminum strip for lithographic print plate carriers, the method for producing the aluminum alloy according to the invention as well as the aluminum strip according to the invention for lithographic print plate carriers and the use thereof. For this purpose, reference is made to the description of an exemplary embodiment of the method according to the invention for producing an aluminum alloy in conjunction with the drawing.

BRIEF DESCRIPTION OF THE DRAWING

The single FIGURE in the drawings schematically shows the sequence of the individual method steps for producing an exemplary embodiment of an aluminum alloy according to the invention.

DESCRIPTION

According to the exemplary embodiment shown in the single FIGURE, the production of an aluminum alloy according to the invention begins with an electrolysis 1 of aluminum oxide. The liquid aluminum is then supplied to a stirring station 2 and, alternatively to or accumulatively with respect to the aluminum obtained directly from aluminum oxide, as shown in the FIGURE, cold metal 3 can be supplied to the stirring station. The cold metal contains, as already described above, less aluminum carbide than an aluminum melt produced directly from aluminum oxide, as the latter additionally contains carbon compounds owing to the burning-off of the graphite electrodes and therefore also aluminum carbide. To remove the aluminum carbides from the aluminum melt, the introduction of inert gases or a gas mixture and the stirring is carried out longer than conventionally provided in the stirring station 2. The minimal gassing and stirring time should be between 10 and 20 min. However, longer stirring and gassing times may also be established. The aluminum melt is then supplied to a furnace 4. Gas flushing with reactive and/or inert gases is then carried out in the furnace 4 and the alloying constituents are added. The gas flushings lead to a further reduction in the aluminum carbide content in the aluminum melt. The aluminum alloy is then left to stand in the furnace for a certain period of time so that the gas bubbles previously released in the melt have enough time to arrive at the surface of the aluminum melt. The melt can be left to stand in the furnace for a time period of between 15 and 90 min., preferably of 30 to 60 min. The gas bubbles which have arrived at the surface of the aluminum melt during the gas flushing with reactive and/or inert gases are skimmed from the melt by removing the dross of the aluminum alloy and thus removed from the aluminum alloy. The dross then contains the aluminum carbides flushed out from the aluminum melt.

After the treatment in the furnace 4, the liquid aluminum alloy is supplied to a rotor degassing 5, which operates, for example, by the SNIF method (spinning nozzle inert flotation), for example flushed with argon and/or chlorine. The contaminants are in turn flushed to the bath surface by the fine gas bubbles, the feeding-in of chlorine, in particular, causing the binding of sodium and potassium contaminants to form salts, which are then deposited with the gas bubbles in a dross layer on the aluminum alloy. The dross layer is then removed again.

Finally, the aluminum alloy according to the invention, prior to the casting, is preferably subjected to a filtering with a filter 6, which has a high filter effectiveness for particles with a size of less than or equal to 5 μm. For example, filters 6 with a filter effectiveness of at least 50% for these particles may be used. As aluminum carbides generally adhere to larger particles, generally with a size of about 10 μm, the aluminum carbide content of the aluminum alloy can effectively be further reduced by the filter step. The aluminum alloy can then be supplied to a continuous or discontinuous casting method 7, 8.

Optionally, the aluminum alloy can be subjected to at least one segregation step in a segregation station, not shown, in which the aluminum alloy is heated to a temperature just above the solidus temperature of the aluminum alloy. Heavily contaminated phases of the aluminum melt melt below the solidus temperature, so that these can be pressed out and removed from the aluminum melt. As the contaminated phases generally also contain aluminum carbides, the proportion thereof in the aluminum alloy according to the invention is further reduced by the optional segregation.

Scoop samples of the aluminum alloy, which were taken after the filtering and therefore directly before the casting, exhibited an extremely low aluminum carbide proportion of less than 1 ppm.

What is claimed is:

1. A method for producing an aluminium alloy for lithographic print plate carriers in which during production of the aluminium alloy after electrolysis of aluminium oxide, liquid aluminium, up to casting of the aluminium alloy, is supplied to a plurality of purification steps and proportion of aluminium carbides in the aluminium alloy is lowered by one or more purification steps to less than 10 ppm, comprising at least the following purification steps:

supplying the liquid aluminium to a stirring station after the electrolysis of the aluminium oxide, introducing inert gases into the liquid aluminium whilst stirring, wherein the duration of the stirring and blowing in of the inert gas into the liquid aluminium in the stirring station is at least 10 minutes, filtering the aluminium alloy prior to continuous or strip casting, by using a filter having a filter efficiency for particles with a size of less than or equal to 5 μm.

2. The method of claim 1 wherein a further composition of the aluminium alloy corresponds to an aluminium alloy of the type AA1xxx, AA3xxx or AA8xxx.

3. The method of claim 1 wherein a further composition of the aluminium alloy corresponds to an aluminium alloy of the type AA1050 or AA3103.

4. The method of claim 1 wherein the aluminium alloy has the following alloying constituents in % by weight:

0.05%≤Mg≤0.3%,
Mn≤0.3%;
0.4%≤Fe≤1%,
0.05%≤Si≤0.5%,
Cu≤0.04%,
Ti≤0.04%, and
unavoidable impurities individually maximum 0.01%, in total maximum 0.05% and remainder Al.

5. The method of claim 1 wherein the aluminium alloy has the following alloying constituents in % by weight:

0.1%≤Mg≤0.3%,
Mn≤0.05%;
0.3%≤Fe≤0.4%,
0.05%≤Si≤0.25%,
Cu≤0.04%,
Ti≤0.04%, and
unavoidable impurities individually maximum 0.01%, in total maximum 0.05% and remainder Al.

6. The method of claim 1 wherein the liquid aluminium supplied to the stirring station is obtained at least partially from cold metal.

7. The method of claim 1 wherein aluminium fluorides are added during the stirring of the liquid aluminium in the stirring station.

8. The method of claim 1 wherein, supplying the aluminium to a furnace for adding alloying constituents and leaving it to stand in the furnace for more than 30 minutes after the alloying has taken place in the furnace by stirring and adding of the alloying constituents.

9. The method of claim 1 wherein, supplying the aluminium to a furnace for adding alloying constituents and leaving it to stand in the furnace for more than 60 minutes after the alloying has taken place in the furnace by stirring and adding of the alloying constituents.

10. The method of claim 1 wherein a gas flushing with inert and/or reactive gases takes place in the furnace.

11. The method of claim 1 wherein the aluminium alloy is supplied, after the furnace, to a rotor degassing and is flushed with a mixture of inert and/or reactive gases.

12. The method of claim 1 wherein the aluminium alloy is subjected to at least one segregation step.

13. The method of claim 1 wherein the proportion of aluminium carbides in the aluminium alloy is lowered by one or more purification steps to less than 1 ppm.

14. The method of claim 1 wherein the duration of the stirring and blowing in of the inert gas into the liquid aluminium in the stirring station is at least 15 minutes.

15. An aluminium strip for lithographic print plate carriers produced by continuous or discontinuous casting of an aluminium alloy with subsequent hot and/or cold forming, the aluminium alloy being produced using a method according to claim 1.

16. The aluminium strip of claim 15 wherein rolling oil residues on the aluminium strip for lithographic print plate carriers have been removed by annealing and degreasing the strip.

17. The aluminium strip of claim 15 wherein the aluminium strip is subjected to a first degreasing using an acid or alkaline medium and then subjected to a further degreasing using a pickling process.

18. The aluminium strip of claim 16 wherein the aluminium strip is subjected to a first degreasing using an acid or alkaline medium and then subjected to a further degreasing using a pickling process.

* * * * *

UNITED STATES PATENT AND TRADEMARK OFFICE

CERTIFICATE OF CORRECTION

PATENT NO. : 8,869,875 B2
APPLICATION NO. : 13/423602
DATED : October 28, 2014
INVENTOR(S) : Bernhard Kernig It is certified that error appears in the above-identified patent and that said Letters Patent is hereby corrected as shown below:

Title Page, item (75),

Inventors: Bernhard, Kernig, Cologne (DE)

Should be: Bernhard, Kernig, Köln (DE)

Signed and Sealed this
Tenth Day of March, 2015

Michelle K. Lee

Michelle K. Lee
*Deputy Director of the United States Patent and Trademark Office*